US008899157B2

(12) United States Patent
Marnas

(10) Patent No.: US 8,899,157 B2
(45) Date of Patent: Dec. 2, 2014

(54) AERIAL TRANSPORT INSTALLATION WITH BACK-AND-FORTH MOVEMENT AND MULTIPLE SECTIONS

(75) Inventor: Luc Marnas, Saint-Nizier-du-Moucherotte (FR)

(73) Assignee: Pomagalski, Voreppe (FR)

( * ) Notice: Subject to any disclaimer, the term of this patent is extended or adjusted under 35 U.S.C. 154(b) by 0 days.

(21) Appl. No.: 14/007,762

(22) PCT Filed: Mar. 30, 2012

(86) PCT No.: PCT/FR2012/000122

§ 371 (c)(1),
(2), (4) Date: Sep. 26, 2013

(87) PCT Pub. No.: WO2012/131197

PCT Pub. Date: Oct. 4, 2012

(65) Prior Publication Data

US 2014/0020592 A1 Jan. 23, 2014

(30) Foreign Application Priority Data

Mar. 30, 2011 (FR) ..... 11 00940

(51) Int. Cl.

| | |
|---|---|
| ***B61B 7/00*** | (2006.01) |
| ***B61B 7/04*** | (2006.01) |
| ***B61B 12/02*** | (2006.01) |
| ***B61B 12/10*** | (2006.01) |

(52) U.S. Cl.

CPC ..... *B61B 7/04* (2013.01); *B61B 12/026* (2013.01); *B61B 12/10* (2013.01)

USPC ..... 104/112; 104/173.2

(58) Field of Classification Search

USPC ..... 104/113–117.1, 173.1, 173.2, 172.3, 104/172.4

See application file for complete search history.

(56) References Cited

U.S. PATENT DOCUMENTS

| | | | | | |
|---|---|---|---|---|---|
| 1,831,833 | A | * | 11/1931 | Wright | 403/183 |
| 3,391,650 | A | * | 7/1968 | Goforth et al. | 104/173.2 |
| 3,857,340 | A | * | 12/1974 | Wright | 104/173.2 |
| 4,669,389 | A | * | 6/1987 | Tarassoff | 104/173.2 |
| 5,172,640 | A | * | 12/1992 | Cathiard | 104/173.2 |
| 5,445,081 | A | * | 8/1995 | Kunczynski | 104/165 |
| 2002/0124763 | A1 | * | 9/2002 | Albrich | 104/112 |

(Continued)

FOREIGN PATENT DOCUMENTS

| | | |
|---|---|---|
| EP | 0 179 708 A1 | 4/1986 |
| EP | 0 491 632 A1 | 6/1992 |
| FR | 2 933 359 | 1/2010 |

OTHER PUBLICATIONS

Jul. 10, 2012 International Search Report issued in International Application No. PCT/FR2012/000122.

*Primary Examiner* — Jason C Smith
(74) *Attorney, Agent, or Firm* — Oliff PLC

(57) ABSTRACT

An aerial transport installation with back-and-forth movement includes two carrying-hauling ropes extending in two individual closed loops between two end terminals separated from one another by an intermediate station which is provided with a double pulley. The latter is provided with two grooves having different groove root diameters, such that the ratio of the diameters is equal to the ratio respectively of the axial distance between the first bull-wheel and the double pulley and of the axial distance between the second bull-wheel and the double pulley. The speeds of the vehicles are also different in the two loops.

5 Claims, 2 Drawing Sheets

(56) References Cited

U.S. PATENT DOCUMENTS

| | | | | |
|---|---|---|---|---|
| 2007/0227394 | A1* | 10/2007 | Mugnier | 104/180 |
| 2008/0148987 | A1* | 6/2008 | Beck | 104/112 |
| 2009/0151594 | A1* | 6/2009 | Dur et al. | 104/112 |
| 2010/0282121 | A1* | 11/2010 | Switzeny | 104/112 |
| 2011/0083577 | A1* | 4/2011 | Tilley | 104/96 |
| 2012/0042803 | A1* | 2/2012 | Beck | 104/112 |
| 2013/0098260 | A1* | 4/2013 | Creissels et al. | 104/87 |
| 2013/0263756 | A1* | 10/2013 | Ilcik et al. | 104/112 |
| 2013/0312633 | A1* | 11/2013 | Tilley | 104/112 |
| 2014/0020592 | A1* | 1/2014 | Marnas | 104/112 |

* cited by examiner

AERIAL TRANSPORT INSTALLATION WITH BACK-AND-FORTH MOVEMENT AND MULTIPLE SECTIONS

BACKGROUND OF THE INVENTION

The invention relates to an aerial transport installation with back-and-forth movement comprising:

- two carrying-hauling ropes extending in two individual closed loops between two end terminals separated from one another by an intermediate station,
- vehicles suspended on the two carrying-hauling ropes by non-detachable fixed grips to perform back-and-forth runs between the end terminals and the intermediate station by means of a geared motor,
- a first bull-wheel in one of the end terminals,
- a second bull-wheel in the other end terminal,
- and a common double pulley in the intermediate station.

STATE OF THE ART

The document EP179708 describes an aerial transport installation having at least two sections each comprising a carrying-hauling rope driven in rotation in a closed loop by a motor. The cars are coupled to the rope on the line by detachable grips, and each rope loop passes in an end terminal on a bull-wheel. The two loops are connected to one another in an intermediate station housing two return pulleys. The two sections are connected by joining tracks which are connected by switching means to corresponding transfer rails, and friction wheels are arranged at intervals along the joining tracks for driving the carriages. Each section can operate independently from one another, the switching means then being in an inactive position so as not to divert the carriages to the joining tracks. The sections can also be coupled in series by placing the switching means in the active position to transfer the carriages from one section to the next, both on the outgoing stage and on the incoming stage. Such an installation is complicated to achieve as it requires, in each section, a drive motor, a transfer system of the vehicles with detachable grips, and joining tracks.

It is also known to construct an aerial transport installation between two end terminals separated from one another by an intermediate station, the rope being subdivided into two individual closed loops running in bull-wheels and connected to one another by a double pulley situated in an intermediate station. The two grooves of the double pulley present the same diameters. The cars or chairs are connected to the two loops by detachable grips, which require detachment and transfer means in each terminal. The running movement of the first loop passing in the drive bull-wheel provides the force for performing rotation of the double pulley and direct transmission by the double pulley of the forces necessary for the running movement of the second loop.

Such transport installations with multiple stations and detachable vehicles require a large amount of space to accommodate the passenger loading and unloading stations.

An aerial transport installation of back-and-forth type with fixed grips also exists having two successive sections, two bull-wheels, and in the intermediate station a pair of adjacent pulleys having the same diameters. Each section has its own variable-speed drive motor to adjust the running speed of the vehicles in each section.

Object of the Invention

The object of the invention consists in providing an aerial transport installation with back-and-forth movement and multiple sections having compact stations for loading and unloading passengers and enabling synchronized arrival of the vehicles in the stations independently from the length of the sections.

The transport installation according to the invention is characterized in that the double pulley of the intermediate station is provided with two grooves having different diameters, such that the ratio of the diameters of said grooves is equal to the ratio of the axial distances between the double pulley and respectively the first bull-wheel and the second bull-wheel.

Advantageously, the ratio of the diameters of the double pulley is equal to the ratio of the running speeds of the vehicles respectively along the carrying-hauling ropes of the first loop and of the second loop.

For sections of different lengths, the speed of the vehicles is adjusted in each section to the ratio of the diameters of the double pulley so that the vehicles reach the stations at the same time. It is therefore possible to use a single geared motor for performing back-and-forth driving of all the vehicles.

The main direction of the first loop can be aligned with that of the second loop, the three stations being arranged in a rectilinear direction.

The reversible geared motor can be installed according to the environment of the site either in one of the end terminals or in the intermediate station. It is also possible for the two loops of carrying-hauling ropes to form any angle between them.

BRIEF DESCRIPTION OF THE DRAWINGS

Other advantages and features will become more clearly apparent from the following description of an embodiment of the invention given for non-restrictive example purposes only and represented in the appended drawings, in which.

DETAILED DESCRIPTION OF THE INVENTION

Figure 1:
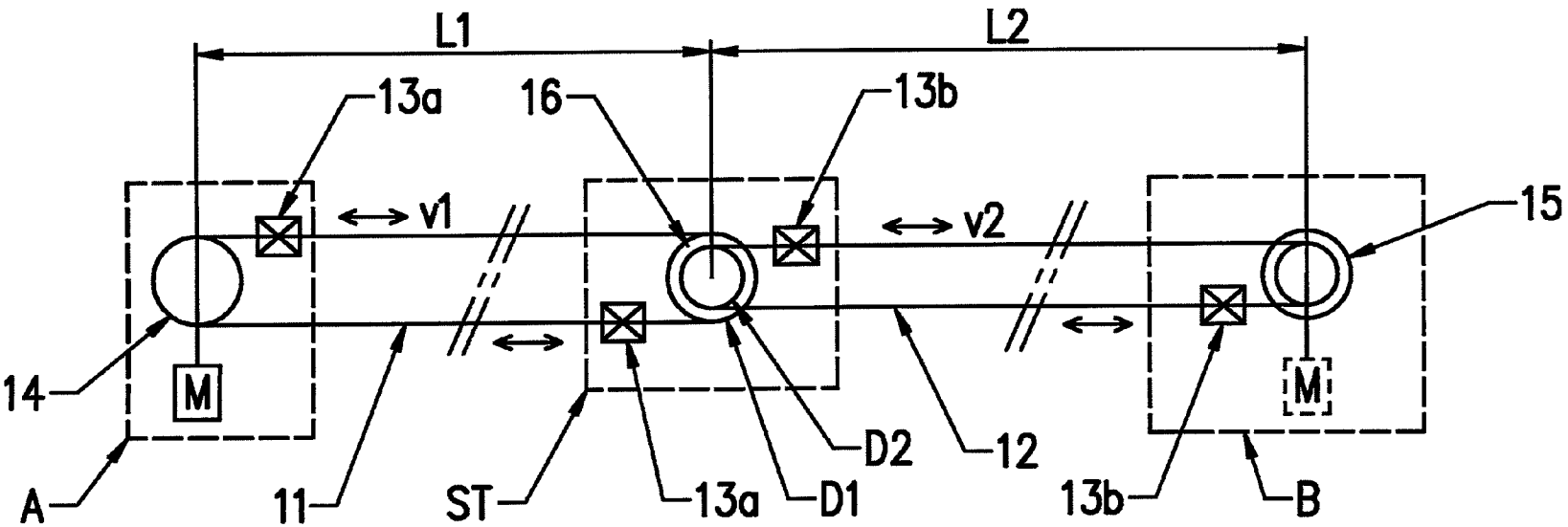
FIG. 1 is a schematic plan view of an aerial transport installation with back-and-forth movement and with a double pulley in the intermediate station, one of the end terminals acting as driving station.

With reference to FIG. 1, an aerial transport installation 10 with back-and-forth movement is equipped with two carrying-hauling ropes 11, 12 extending in closed loops between two end terminals A, B separated from one another by an intermediate station ST. Cars or other vehicles 13*a*, 13*b* are suspended on the two carrying-hauling ropes 11, 12 by non-detachable fixed grips so as to perform back-and-forth movements between the two end terminals A and B and the intermediate station ST. Passenger loading and unloading platforms are provided in each terminal and station A, B and ST.

The two loops of carrying-hauling ropes 11, 12 form lines that are independent from one another, which pass in end terminals A, B on first and second bull-wheels 14, 15, and in intermediate station ST on a common double pulley 16. The three pulleys 14, 15, 16 each have a vertical axis, the first bull-wheel 14 being coupled to a reversible geared motor M for driving the back-and-forth movement mechanism. End terminal A acts in this case as driving station for driving the two carrying-hauling ropes 11, 12.

In the embodiment of FIG. 1, reversible geared motor M could be mechanically coupled to second bull-wheel 15 (see broken lines) and not to first bull-wheel 14. End terminal B in this case acts as driving station instead of the other end terminal A.

The common double pulley 16 located in intermediate station ST is provided with two grooves having different groove root diameters D1 and D2. The loop of carrying-hauling rope 11 passes around the outer receiving groove of diameter D1, whereas the other loop of carrying-hauling rope 12 passes around the inner receiving groove of smaller diameter D2 than that of D1. Each of the grooves of double pulley 16 acts as a return pulley and receives one only of the two loops for simultaneous transmission of the driving movement of geared motor M to the two carrying-hauling ropes 11, 12.

The structure of double pulley 16 is chosen such that the ratio of the groove root diameters D1/D2 is equal to the ratio of the distances L1/L2, L1 being the axial length separating the centres of first bull-wheel 14 and of double pulley 16, and L2 being the axial length separating the centres of second bull-wheel 15 and of double pulley 16.

This relation D1/D2=L1/L2 is also equal to the ratio of the speeds v1/v2 of vehicles 13*a*, 13*b* in the two loops, respectively along carrying-hauling rope 11 and carrying-hauling rope 12. This difference of the speeds of vehicles 13*a* and 13*b* in the two loops results from the ratio of diameters D1 and D2 of double pulley 16 housed in intermediate station ST, and also from the lengths of the back-and-forth sections in the two independent loops.

Operation of transport installation 10 of FIG. 1 is as follows:

When geared motor M drives the first bull-wheel in rotation in the clockwise direction, double pulley 16 and second bull-wheel 15 rotate in the same direction. Vehicles 13*a* of the first loop are moved at the speed v1 in opposite directions along the two sides of carrying-hauling rope 11, the first ones during the outward run and the others during the return run. Vehicles 13*b* of the second loop are moved at the speed v2 in opposite directions along the two sides of the other carrying-hauling rope 12, the first ones during the outward run and the others during the return run.

When the direction of rotation of first bull-wheel 14 takes place in the counter-clockwise direction, movement of vehicles 13*a*, 13*b* is reversed with respect to the movement described above, and they return to their original positions illustrated in FIG. 1. Vehicles 13*a* and 13*b* located on the same side of the two loops move during the return run, whereas vehicles 13*a*, 13*b* located on the other side of the loops are driven on the outward run.

Distances L1 and L2 covered by vehicles 13*a*, 13*b*, and their speeds v1 and v2 in the two loops vary according to the ratio of the diameters D1 and D2 of double pulley 16. Distance L1 covered by vehicles 13*a* is the same during each outward or inward run. The same is the case for distance L2 covered by vehicles 13*b* during each outward or inward run. But distances L1 and L2 are different, as are speeds v1 and v2 in the two loops.

In FIG. 1, the main direction of the first loop is aligned with that of the second loop. The three stations A, B and ST are arranged in a rectilinear direction.

According to an alternative embodiment, geared motor M of FIG. 1 could also be coupled to double pulley 16. In this case, the two bull-wheels 14, 15 act as return and tension pulleys of the two loops.

Figure 2:
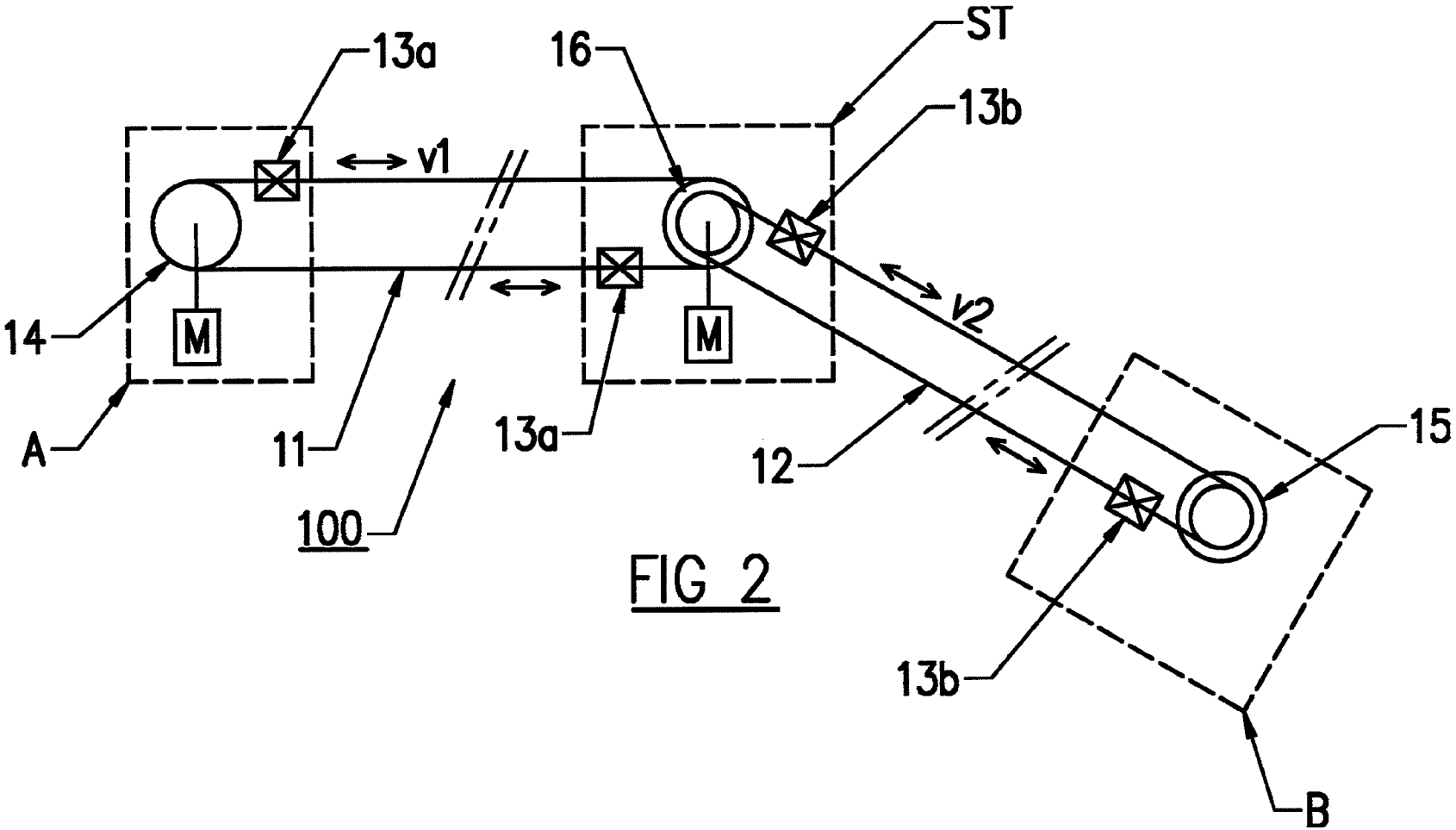
FIG. 2 is an alternative embodiment of FIG. 1, with the driving station in the intermediate station.

In FIG. 2, the two loops of carrying-hauling ropes 11, 12 of transport installation 100 form any angle between them, without any additional structure. Geared motor M is associated with double pulley 16 of intermediate station 16, but could also be coupled with one of end terminals A or B.

It is clear that the transport installation can have a plurality of sections interconnected by several intermediate stations each equipped with a double pulley according to the invention.

The invention claimed is:

1. An aerial transport installation with back-and-forth movement comprising:

two carrying-hauling ropes extending in two individual closed loops between two end terminals separated from one another by an intermediate station, vehicles suspended on the two carrying-hauling ropes by non-detachable fixed grips to perform back-and-forth runs between the end terminals and the intermediate station by means of a geared motor, a first bull-wheel in one of the end terminals, a second bull-wheel in the other end terminal, a common double pulley in the intermediate station, wherein the double pulley of the intermediate station is provided with a first groove having a first groove root diameter D1 and a second groove having a different second groove root diameter D2, such that a ratio of the first and second groove root diameters D1/D2 is equal to a ratio L1/L2 where L1 is an axial distance separating the centers of the first bull-wheel and of the double pulley, and L2 is an axial distance separating the centers of the second bull-wheel and of the double pulley.

2. The transport installation according to claim 1, wherein the ratio of the first and second groove root diameters of the double pulley D1/D2 is equal to a ratio v1/v2 where v1 is a running speed of the vehicle along the carrying-hauling rope of the first loop and v2 is a running speed of the vehicle along the carrying-hauling rope of the second loop.

3. The transport installation according to claim 1, wherein the main direction of the first loop is aligned with that of the second loop, the three stations extending in a rectilinear direction.

4. The transport installation according to claim 1, wherein the two loops of carrying-hauling ropes form any angle between them.

5. The transport installation according to claim 1, wherein the geared motor is coupled to one of the first or second bull-wheels, or directly to the double pulley.

* * * * *